US006685071B2

(12) United States Patent
Prather

(10) Patent No.: US 6,685,071 B2
(45) Date of Patent: Feb. 3, 2004

(54) CONVERTIBLE BAG FOR TRANSPORTING ARTICLES AND FOR BALLISTIC PROTECTION

(76) Inventor: Jeffrey Prather, 5755 E. River Rd., Tucson, AZ (US) 85750

( * ) Notice: Subject to any disclaimer, the term of this patent is extended or adjusted under 35 U.S.C. 154(b) by 0 days.

(21) Appl. No.: 10/050,506

(22) Filed: Jan. 16, 2002

(65) Prior Publication Data

US 2003/0132260 A1 Jul. 17, 2003

(51) Int. Cl.[7] ..... A45C 15/00

(52) U.S. Cl. ..... 224/576; 2/2.5; 224/153; 224/627; 224/628; 224/629; 224/630

(58) Field of Search ..... 224/576, 153, 224/627, 628, 630, 629; 109/49.5; 2/2.5, 463, 467

(56) References Cited

U.S. PATENT DOCUMENTS 3,843,969 A * 10/1974 George et al. ..... 2/2.5
4,546,863 A * 10/1985 Kaufman ..... 190/102
4,697,285 A * 10/1987 Sylvester ..... 2/2.5
4,830,245 A * 5/1989 Arakaki ..... 224/628
5,031,733 A * 7/1991 Chang ..... 190/1
5,060,314 A * 10/1991 Lewis ..... 2/2.5
5,327,811 A * 7/1994 Price et al. ..... 89/36.05
5,431,318 A * 7/1995 Garcia ..... 224/192
5,644,792 A * 7/1997 Tishler et al. ..... 2/2.5
5,828,653 A 10/1998 Goss
5,865,314 A 2/1999 Jacober
6,161,738 A * 12/2000 Norris ..... 224/153
6,419,132 B1 * 7/2002 Reed et al. ..... 224/153

* cited by examiner

*Primary Examiner*—Gregory Vidovich
*Assistant Examiner*—Maerena W. Brevard
(74) *Attorney, Agent, or Firm*—Robert D. Atkins; Quarles & Brady Streich Lang LLP

(57) ABSTRACT

A container for transporting articles that transforms into a ballistic protection unit includes a bag and a detachable panel. The bag includes a first compartment for containment of at least one piece of ballistic shield material. The detachable panel also contains at least one piece of ballistic shield material and is coupled to the bag by at least a first strap. The detachable panel is detachably coupled to the bag. During use, the user may detach the detachable panel from the bag and the bag may be placed over a shoulder of the user, protecting the user from high speed projectiles.

31 Claims, 5 Drawing Sheets

CONVERTIBLE BAG FOR TRANSPORTING ARTICLES AND FOR BALLISTIC PROTECTION

FIELD OF THE INVENTION

The present invention relates to a bag, more particularly, a bag that may be converted into a ballistic protection device and which can be deployed and worn for protection from bullets or shrapnel.

BACKGROUND OF THE INVENTION

Bullet proof vests have been worn by police and protection groups for years. Due to heightened concerns of safety in situations where no police or military persons are present, a simple device for civilians is needed that offers excellent protection, is unobtrusive, easy to use and easy to carry.

As mentioned previously, devices of the prior art include bullet proof vests. Bullet proof vests serve as excellent protection for the upper body, but are too obvious, hot, unfashionable and constraining for every day use by a civilian.

Other devices include several variations of a bullet proof shield. In one form found in the prior art, a protective ballistic panel includes a first-impact, front layer and a spaced rear layer each of which is made of a relatively tough, nonmetallic material. This variation only protects one side of the user's body, is difficult to carry around for everyday use and is equally as unfashionable as the bullet proof vest.

In another variation, a backpack carrier is wrapped with layers of bullet proof material creating a bulletproof backpack. The backpack may be held up like a shield in the event that the user comes under fire. Though the backpack carrier configuration is easy to carry and unobtrusive, the backpack also acts as a shield and protects only one side of the user's body. Similar concerns arise with another bag-like variation where the bag-style container includes a compartment in the bag that contains bullet proof material and panels attached to the bag that unfold to enlarge the backpack shield. Although this bag configuration also solves the problems of fashionability and constraint, full protection is still not afforded with the shield.

Thus, there exists a need for an easily transportable, unobtrusive, practical device that not only can be carried by its user, but can be easily and quickly deployed and provide protection to more than a single portion of the user's body.

SUMMARY OF THE INVENTION

The present invention provides a fashionable, transportable, dual usage device that is easily deployable and that provides protection to more than a single portion of the user's body.

According to one aspect of the present invention, a hand-held case is convertible to a ballistic protection device. A case has first and second sides joined around three ends to form a cavity suitable for carrying articles. The first side of the case includes at least one compartment having dimensions substantially within a surface area of the first side of the case. A ballistic resistant material is disposed within the compartment of the first side of the case. A detachable panel comprising ballistic resistant material is attachable to and detachable from the case. A first strap is connected between the detachable panel and the case for hanging the detachable panel and the compartment over opposite sides of a body to provide ballistic protection.

In yet another aspect of the present invention, a method of converting a bag to a ballistic protection device comprises providing a bag having at least one compartment substantially covering a surface area of a first side of the bag, providing ballistic resistant material disposed within the compartment, removing a ballistic resistant panel from the bag, and placing a first strap connected between the bag and the ballistic resistant panel over a shoulder for hanging the ballistic resistant panel and the compartment over opposite sides of a body to provide ballistic protection.

Other features and advantages of the present invention will become apparent from the following detailed description, taken in conjunction with the accompanying drawings, which illustrate, by way of example, the principles of the invention.

DETAILED DESCRIPTION OF THE DRAWINGS

Figure 1:
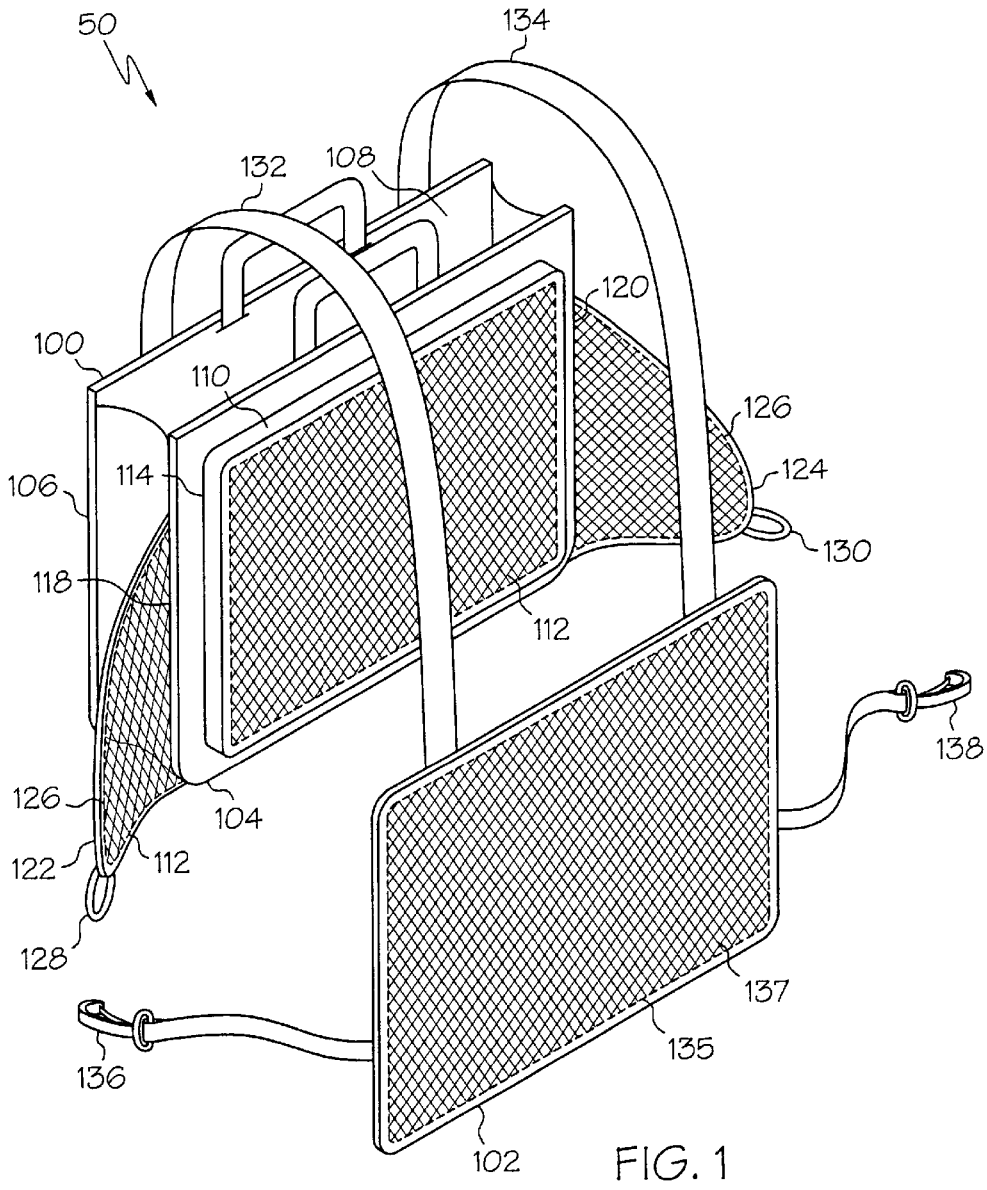
FIG. 1 is a perspective view of a ballistic protection container according to an exemplary embodiment of the present invention.

A perspective view of an embodiment of the ballistic protection container is depicted in FIG. 1. As illustrated therein, the present invention includes a bag 100 and a detachable panel 102. The bag 100 is shown to include at least a first side 104 and a second side 106. The first side 104 and second side 106 are joined by any one of numerous means of coupling two sides of a bag 100 together, including but not limited to fabric, mesh material, or plastic. A cavity 108 is formed between the joined first 104 and second 106 sides, and may be used for containing articles such as personal items, books, business papers or computers.

The first side 104 includes at least a first compartment 110 that may be used to house a first piece of bullet-proof material 112. In the preferred embodiment, the first piece of bullet-proof material 112 may be a single sheet that is substantially similar in size to the first compartment 110. The first piece of bullet-proof material 112 may be any one of numerous bullet-proof materials such as a Kevlar-type or Spectra-type material or other bullet resistant textile fabric. Additionally, the first piece of bullet-proof material 112 is not limited to a single piece, but may comprise multiple pieces of bullet-proof material. It will be further appreciated that the first compartment 110 may be configured to allow the first piece of bullet-proof material 112 to be readily inserted and removed from it, or the first compartment 110 may be configured such that the bullet-proof material is a permanent part of the first side 104. The first side 104 may also include a second compartment 114 that may be used to house an additional piece of bullet-proof material 115 such as, for example, a rigid metal plate. As is generally known in the art, such plates are useful in resisting penetration by relatively high energy projectiles. If the first compartment 110 is configured to allow insertion and removal of the bullet-proof material 112, the first compartment 110 may also allow insertion and removal of additional bullet-proof material.

The first side 104 of the bag in FIG. 1 is also shown to have a first side edge 118 and a second side edge 120. A first side flap 122 may be coupled to the first side edge 118 and a second side flap 124 may be coupled to the second side edge 120. The first 122 and second 124 side flaps may each include a side flap compartment 126. These side flap compartments 126 may also be used to house a bullet-proof material to thereby provide extra protection to the user's sides. As with the first compartment 110, the side flap compartments 126 may be configured to allow bullet-proof material 112 to be readily inserted and removed from it, or the side flap compartment 126 may be configured such that the bullet-proof material 112 is a permanent part of the side flap compartments 126. A first fastener 128 and a second fastener 130 may be attached to the first 122 and second 124 side flaps. The purpose of the first 128 and second 130 fasteners will become clear in the description further below.

The detachable panel 102 is coupled to the bag 100 via a first strap 132 and a second strap 134. It will be appreciated by one skilled in the art that the detachable panel 102 may also be coupled to the bag 100 with only the first strap 132 or more than two straps. Further, the detachable panel 102 may be coupled to the bag 100 using other means of attachment, such as string or chain material, and is not limited to straps. The detachable panel 102 includes a second compartment 135 in which a second piece of bullet-proof material 137 may be housed. As stated above, the bullet-proof material 137 may be one of any numerous materials that prevent penetration of high speed ballistic weapons such as Kevlar-type or Spectra-type material or other bullet-resistant textile fabric, and is not limited to a single sheet of material, but may consist of multiple pieces. Also consistent with the first compartment 110, the second compartment 135 may be configured to allow the second piece of bullet-proof material 137 to be readily inserted and removed from it, or the second compartment 135 may be configured such that the bullet-proof material 137 is a permanent part of the detachable panel 102.

Figure 2:
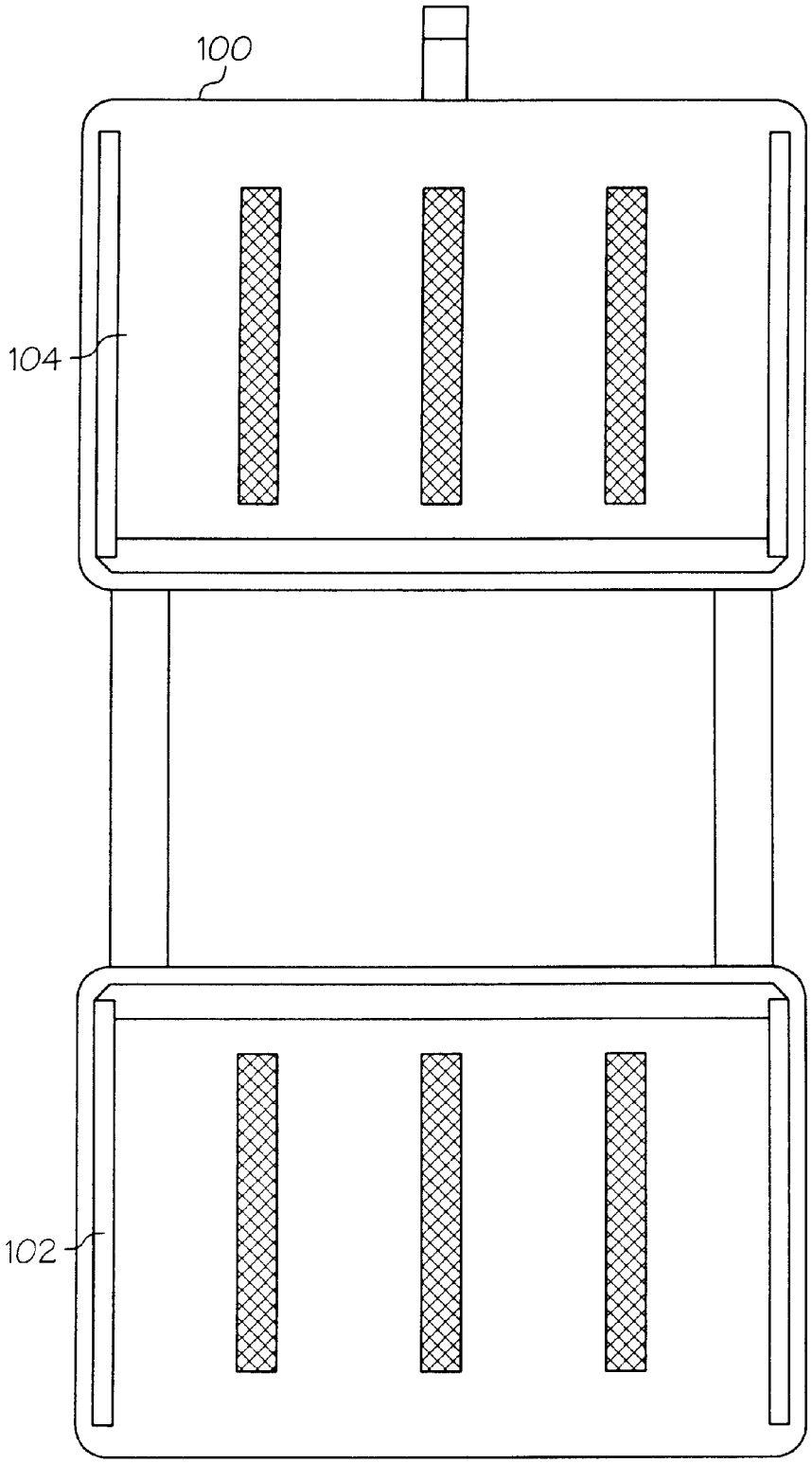
FIG. 2 is a side view of a ballistic protection container according to an exemplary embodiment of the present invention of FIG. 1.

In the preferred embodiment, the detachable panel 102 is dimensioned substantially similar to the second side 104 of the bag 100, though in other embodiments the detachable panel 102 may be of different sizes. The detachable panel 102 is preferably coupled to the second side 104 by any detachable mechanism that allows two pieces to be readily attached together and detached from one another. When detaching the detachable panel 102 from the second side 104 it is preferable that the detachable panel 102 may be quickly detachable for quick deployment purposes. As depicted in FIG. 2, this may be accomplished by affixing a hook and loop type of tape on a side of the detachable panel 102 and on the second side 104 of the bag 100 so that the detachable panel 102 may be discretely stored against the second side 104 of the bag 100, but may be rapidly removed therefrom in emergency situations. The detachable panel 102 may also be attached to the second side 104 by other means including, but not limited to, metal snaps or hooks and eyes. Turning back to FIG. 1, a third fastener 136 and a fourth 138 fastener may be attached to the detachable panel 102. These fasteners 136, 138 allow the detachable panel 102 and the bag 100 to be coupled together when the container 50 is being used for ballistic protection. This will become clear when the operation of the container 50 is described further below.

It will be appreciated that, although FIG. 1 shows the detachable panel 102 attachable to the second side 104, the detachable panel 102 may alternatively be attached to the first side 106 of the bag.

Figure 3:
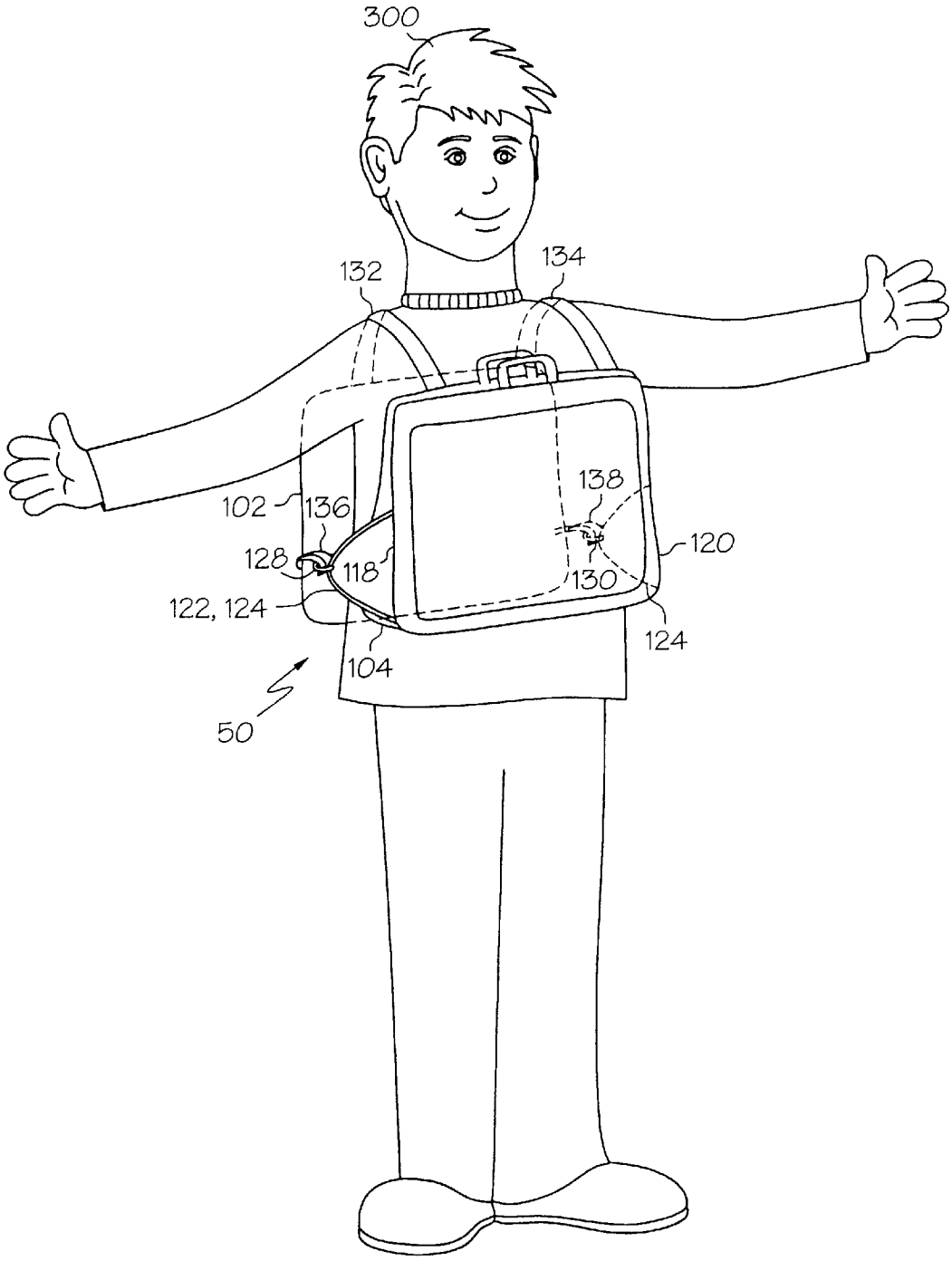
FIG. 3 is a perspective view of a ballistic protection container being worn by a user according to an embodiment exemplary of the present invention.

As shown in FIG. 3, during non-hostile times, the user 300 may carry and use the bag 100 for everyday, ordinary purposes such as for carrying books, personal belongings, computers or business papers. Once the user 300 senses danger or comes under fire, the user 300 may deploy the ballistic protection container 50 by detaching the detachable panel 102 from the first side 104, straightening out the first 132 and second 134 straps, if necessary, and placing the container 50 over the user's head. In particular, the first strap 132 is placed on one of the user's shoulders while the second strap 134, if included, is placed on the user's other shoulder, thus allowing for the first side 104 of the bag 100 to rest directly on the user's front side and the detachable panel 102 to rest on the user's back side. In the alternative, the bag 100 may be placed on the user's body such that the first side 104 of the bag 100 rests on the user's backside while the detachable panel 102 rests on the user's front side. For additional protection, the user may straighten the side flaps 122, 124 out from the first side edge 118 and second side edge 120, such that the side flaps 122, 124 cover the sides of the user's body. Also shown in FIG. 3, the first fastener 128 may be fastened to the third fastener 136 and the second fastener 130 may be fastened to the fourth fastener 138. Such fastening may be accomplished by any one of numerous means by which two pieces are fastened together, for example via hook and loop type tape straps with a hook and eye configuration on either end or straps with latches on either end. Fastening the first 128, second 130, third 136 and fourth 138 fasteners further secures the first side 104 and detachable panel 102 against the user's body.

Figure 4:
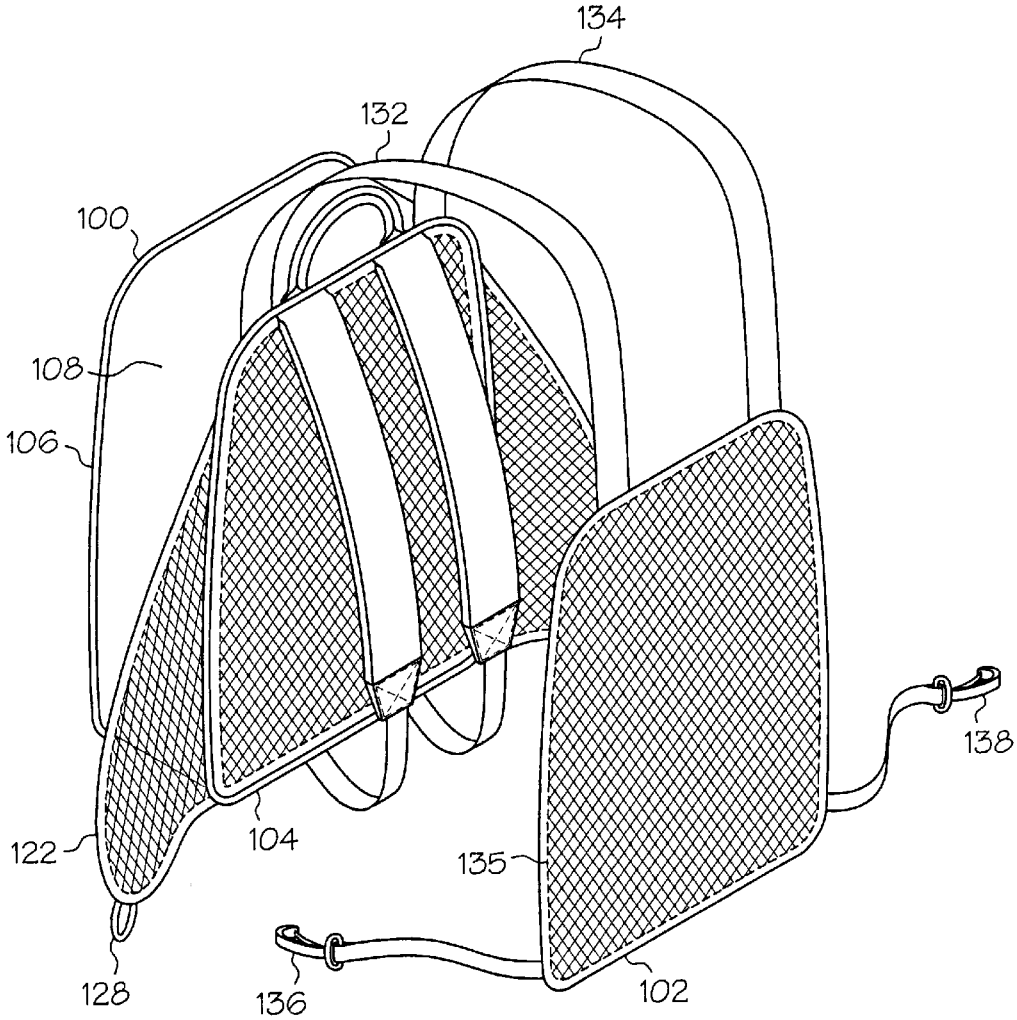
FIG. 4 is a perspective view of a ballistic protection container according to an another embodiment exemplary of the present invention.
Figure 5:
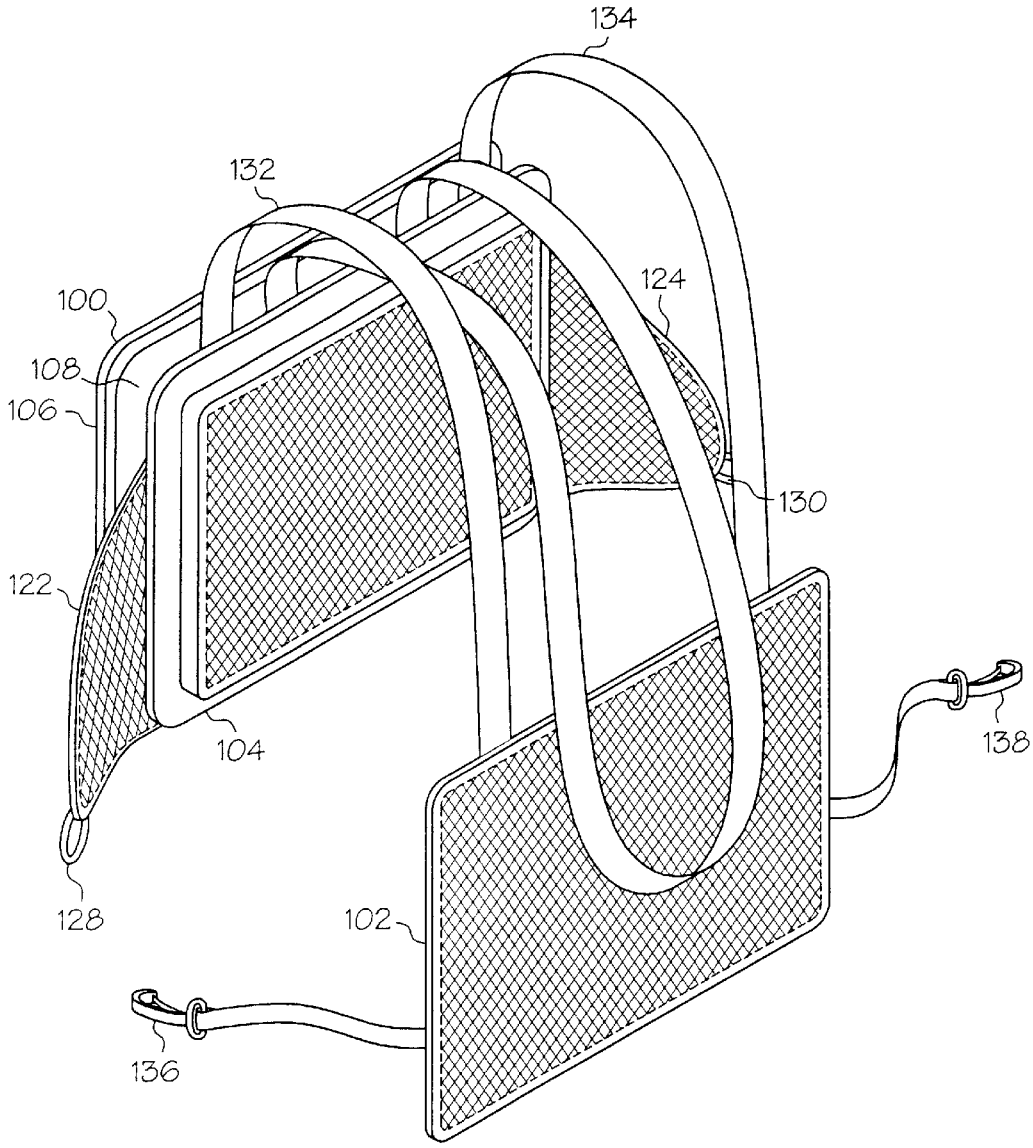
FIG. 5 is a perspective view of a ballistic protection container according to yet another exemplary embodiment of the present invention.

The embodiments in FIGS. 1, 2 and 3 are shown in a briefcase or computer carrying case form, but the present invention is not limited to such an embodiment. Where like reference numerals are used for like parts of the embodiment depicted in FIG. 1, FIG. 4 shows that the present invention may also take the form of a backpack. Likewise, as shown in FIG. 5, the present invention may also take the form of a purse.

While the invention has been described with reference to preferred embodiments, it will be understood by those skilled in the art that various changes may be made and equivalents may be substituted for elements thereof without departing from the scope of the invention. Therefore, it is intended that the invention not be limited to particular embodiments disclosed as the best mode contemplated for carrying out this invention, but that the invention will include all embodiments falling within the scope of the appended claims.

I claim:

1. A container for transporting articles that is useful for transforming into a ballistic protection unit comprising:

a bag having at least a first side and a second side joined along one or more portions thereof to form a cavity therebetween, the bag first side having at least a first side edge, a second side edge, and a compartment adapted to receive a first piece of ballistic shield material therein;

a first side flap coupled to the first side edge, the first side flap having a compartment adapted to receive at least a second piece of ballistic shield material;

a second side flap coupled to the second side edge, the second side edge having a compartment adapted to receive at least a third piece of ballistic shield material;

a detachable panel having at least a first side, a second side, and a compartment adapted to receive at least a second piece of ballistic shield material therein, at least one of the detachable panel first and second sides detachably coupled adjacent to at least a portion of one of the bag first and second sides; and a strap having at least a first end section and a second end section, the first end section coupled to at least a portion of one of the bag first and second sides, and the second end section coupled to one of the detachable panel first and second sides, whereby the detachable panel may be detached from the bag by a user and the strap placed over a shoulder of the user, such that the detachable panel substantially covers one side of the user and the bag substantially covers another side of the user.

2. A hand-held case convertible to a ballistic protection device, comprising:

a case having first and second sides joined around three ends to form a cavity suitable for carrying articles, wherein the first side of the case includes at least one compartment having dimensions substantially within a surface area of the first side of the case;

a ballistic resistant material disposed within the compartment of the first aide of the case;

a detachable panel comprising ballistic resistant material and being attachable to and detachable from the case; and a first strap connected between the detachable panel and the case for hanging the detachable panel and the compartment over opposite sides of a body to provide ballistic protection.

3. The hand-held case of claim 2, further including a second strap connected between the detachable panel and the case, wherein the first and second straps hang the detachable panel and compartment over opposite sides of the body to provide ballistic protection.

4. The hand-held case of claim 2, further including first and second side panels which comprise ballistic resistant material coupled between opposite sides of the case and the detachable panel.

5. The hand-held case of claim 4, further including:

a first fastener for securing one end of the first side panel between the case and the detachable panel; and a second fastener for securing an opposite end of the second side panel between the case and the detachable panel.

6. A ballistic protection device, comprising:

a bag suitable for carrying articles, wherein a first side of the bag includes at least one compartment substantially covering a surface area of the first side of the bag;

a ballistic resistant material disposed within the compartment;

a ballistic resistant panel removable from the bag; and a first strap connected between the bag and the ballistic resistant panel for hanging the compartment and the ballistic resistant panel over opposite sides of a body to provide ballistic protection.

7. The ballistic protection device of claim 6, further including a second strap connected between the ballistic resistant panel and the bag, wherein the first and second straps hang the ballistic resistant panel and compartment over opposite sides of the body to provide ballistic protection.

8. The ballistic protection device of claim 7, further including first and second side panels coupled between opposite sides of the bag and the ballistic resistant panel.

9. The ballistic protection device of claim 8, wherein the first and second side panels each comprise ballistic resistant material.

10. The ballistic protection device of claim 8, further including:

a first fastener for securing one end of the first side panel between the bag and the ballistic resistant panel; and a second fastener for securing an opposite end of the second side panel between the bag and the ballistic resistant panel.

11. The ballistic protection device of claim 6, wherein the compartment includes a plurality of compartments substantially covering the surface area of the first side of the bag.

12. The ballistic protection device of claim 6, wherein the ballistic resistant material comprise a plurality of pieces of ballistic resistant material.

13. The ballistic protection device of claim 6, wherein the ballistic resistant material is sealed within the compartment.

14. The ballistic protection device of claim 6, wherein the bag further includes a second compartment for holding a second ballistic resistant material.

15. The ballistic protection device of claim 14, wherein the second ballistic resistant material includes a metal plate.

16. The ballistic protection device of claim 6, wherein the bag is a hand-held case.

17. The ballistic protection device of claim 6, wherein the bag is a backpack.

18. An apparatus which can be converted to a ballistic protection device, comprising:

a bag having at least one compartment substantially covering a surface area of a first side of the bag;

a ballistic resistant material disposed within the compartment;

a ballistic resistant panel removable from the bag; and a first strap connected between the bag and the ballistic resistant panel.

19. The apparatus of claim 18, further including a second strap connected between the ballistic resistant panel and the bag, wherein the first and second straps hang the ballistic resistant panel and compartment over opposite sides of the body to provide ballistic protection.

20. The apparatus of claim 18, further including first and second side panels comprising ballistic resistant material coupled between opposite sides of the bag and the ballistic resistant panel.

21. The apparatus of claim 20, further including:

a first fastener for securing one end of the first side panel between the bag and the ballistic resistant panel; and a second fastener for securing an opposite end of the second side panel between the bag and the ballistic resistant panel.

22. The apparatus of claim 18, wherein the bag further includes a second compartment for holding a second ballistic resistant material.

23. The apparatus of claim 22, wherein the second ballistic resistant material includes a metal plate.

24. A method of converting a bag to a ballistic protection device, comprising:

providing a bag having at least one compartment substantially covering a surface area of a first side of the bag;

providing ballistic resistant material disposed within the compartment;

removing a ballistic resistant panel from the bag; and placing a first strap connected between the bag and the ballistic resistant panel over a shoulder for hanging the ballistic resistant panel and the compartment over opposite sides of a body to provide ballistic protection.

25. The method of claim 24, further including providing a second strap connected between the bag and the ballistic resistant panel, wherein the first and second straps hang the ballistic resistant panel and compartment over opposite sides of the body to provide ballistic protection.

26. The method of claim 24, further including:

providing first and second side panels comprising ballistic resistant material coupled between opposite sides of the beg and the ballistic resistant panel;

securing one end of the first side panel between the ballistic resistant panel and the bag with a first fastener; and securing an opposite end of the second side panel between the ballistic resistant panel and the bag with a second fastener.

27. A method of manufacturing a beg which is convertible to a ballistic protection device, comprising:

providing a bag Suitable for carrying articles and having at least one compartment substantially covering a surface area of a first side of the bag;

disposing ballistic resistant material within the compartment;

providing a detachable panel which is removable from the bag end comprises ballistic resistant material; and connecting a first strap between the bag and the detachable panel to hang the detachable panel and the compartment over opposites sides of a body to provide ballistic protection.

28. The method of claim 27, further including providing a second strap connected between the bag and the detachable panel, wherein the first and second straps hang the detachable panel and compartment over opposite sides of the body to provide ballistic protection.

29. The method of claim 27, further including:

providing first and second side panels comprising ballistic resistant material adapted for coupled opposite sides of the bag to the detachable panel;

providing a first fastener to secure one end of the first side panel between the detachable panel and the bag; and providing a second fastener to secure an opposite end of the second side panel between the detachable panel and the bag.

30. The method of claim further including the steps of:

providing a second compartment in the bag; and disposing a second ballistic resistant material in the second compartment.

31. The method of claim, wherein the second ballistic resistant material includes a metal plate.

* * * * *